US005391008A

United States Patent [19]

Hattori

[11] Patent Number: 5,391,008

[45] Date of Patent: Feb. 21, 1995

[54] PRINTER HAVING CONTINUOUS SHEET SUPPLY MECHANISM AND AUTOMATIC CUT SHEET SUPPLY MECHANISM

[75] Inventor: Makoto Hattori, Nagoya, Japan

[73] Assignee: Brother Kogyo Kabushiki Kaisha, Nagoya, Japan

[21] Appl. No.: 128,104

[22] Filed: Sep. 29, 1993

[30] Foreign Application Priority Data

Oct. 12, 1992 [JP] Japan ..... 4-273158
May 20, 1993 [JP] Japan ..... 5-118408

[51] Int. Cl.[6] ..... B41J 11/58

[52] U.S. Cl. ..... 400/605; 271/9; 271/145; 400/624; 400/693; 400/607

[58] Field of Search ..... 400/605, 607, 607.2, 400/608.2, 608.4, 610, 610.1, 610.2, 624, 691, 692, 693, 694; 346/145; 271/9, 145

[56] References Cited

U.S. PATENT DOCUMENTS 5,066,151 11/1991 Durr et al. ..... 400/605
5,080,515 1/1992 Engelhardt et al. ..... 400/624
5,141,346 8/1992 Nakagawa ..... 400/605
5,308,175 5/1994 Ito ..... 400/605

FOREIGN PATENT DOCUMENTS 0227116 7/1987 European Pat. Off. .
0264111 4/1988 European Pat. Off. .
0374901 6/1990 European Pat. Off. .
0423911 4/1991 Germany .
0095973 4/1988 Japan ..... 400/624
0231965 9/1988 Japan ..... 400/605
2156280 10/1985 United Kingdom .

*Primary Examiner*—Edgar S. Burr
*Assistant Examiner*—Christopher A. Bennett
*Attorney, Agent, or Firm*—Oliff & Berridge

[57] ABSTRACT

A printer including a printing section capable of printing on both continuous sheet and cut sheet paper, including a printer housing containing the printing section, a pivot shaft being provided to the printer housing; a continuous sheet supplier for supplying continuous sheet to the printing section; an automatic sheet supply mechanism supported by the pivot shaft and pivotable between a cut-sheet supply position, for supplying one cut sheet at a time to the printing section, and a separation position, for separating the automatic sheet supply mechanism from the continuous sheet supplier and for providing an open space therebetween; and a fixing shaft and fixing lever for fixing the automatic sheet supply mechanism in the separation position.

20 Claims, 8 Drawing Sheets

PRINTER HAVING CONTINUOUS SHEET SUPPLY MECHANISM AND AUTOMATIC CUT SHEET SUPPLY MECHANISM

BACKGROUND OF THE INVENTION

1. Field of the Invention

The present invention relates to a printer and more particularly to a printer including a continuous sheet supply means and an automatic sheet supply mechanism. To facilitate explanations, directional expressions such as "front," "rear," "above," "below," "left," "right," "laterally," and the like are used hereinafter to define various parts when the printer is disposed in an orientation in which it is intended to be used. Specifically, the side of a printer to which an automatic sheet supply mechanism is disposed will be considered the front side and the opposite side of the printer will be considered the rear side.

2. Description of the Related Art

As shown in FIG. 1, there has been known a printer 101 with a tractor unit 115, acting as a continuous sheet supply means for supplying a continuous sheet paper, and an automatic sheet supply mechanism 105, for supplying single cut sheets of paper, disposed separately on opposing front and rear sides of the printer 101. Single cut sheets of paper are supplied from the automatic sheet supply mechanism 105 to a printhead 104 and discharged to the stacker 145 at the rear side. Continuous sheet paper, on the other hand, is supplied from the tractor unit 115 disposed at the rear side of the printer 101 to the printhead 104 and discharged from the front side of the printer 101.

However, there has been a problem in this type of printer 101 in that an operator must go around to the rear side of the printer 101 to change the continuous sheet paper. This problem is especially prominent when the printer 101 is installed with the rear side against a wall. In this case the entire printer 101 must be moved to replace the continuous sheet paper.

As shown in FIG. 2, there is known a conventional printer 201 which has improved this point by having both the tractor unit 215 and the automatic sheet mechanism 205 disposed at the front side of the printer 201. The automatic sheet supply mechanism 205 of this printer 201 is detachably mounted to the front side of the printer 201 at the position where the continuous sheet is drawn in by the tractor unit 215. The automatic sheet supply mechanism includes a hopper 222 for holding stacked single cut sheets, a separation means 210 made from a pick-up roller and a separation roller, and a drive source and a drive mechanism (neither shown) for driving the hopper 222 and the separation means 210. The stacked single cut sheets of paper held in the hopper 222 are separated one at a time by the separation means 210 and transmitted to the printhead 204. A control panel (not shown) is disposed at the upper front side of this printer 201 by which an operator inputs various instructions and commands, However, as shown in FIG. 2, the automatic sheet supply mechanism 205 obstructs access to the tractor unit 215 and not enough space is provided to change the continuous sheet of paper. Therefore, to secure sufficient space to change the continuous sheet paper, an operator must first remove the automatic sheet supply mechanism from the printer body 203. As a result, changing the continuous sheet paper is a troublesome operation.

SUMMARY OF THE INVENTION

It is an objective of the present invention to solve the above-mentioned problems and provide a printer in which using both single cut sheet paper and continuous sheet is possible and changing the continuous sheet of paper can be performed easily.

In order to solve the above-described problems, a printer according to the present invention preferably comprises a printer housing containing the printing section, a pivot shaft being provided to the printer housing; continuous sheet supply means for supplying continuous sheet to the printing section; an automatic sheet supply mechanism supported by the pivot shaft and pivotable between a cut-sheet supply position, for supplying one cut sheet at a time to the printing section, and a separation position, for separating the automatic sheet supply mechanism from the continuous sheet supply means and for providing an open space therebetween; and a fixing means for fixing the automatic sheet supply mechanism in the separation position.

The fixing means preferably includes a fixing shaft provided at a predetermined position on the printer housing; and a fixing lever movably supported to the sheet supply mechanism between an engagement position, for engaging the fixing lever with the fixing shaft thereby fixing the automatic sheet supply mechanism in the separation position, and a non-engagement position, for releasing engagement between the fixing lever and the fixing shaft.

The automatic sheet supply mechanism is preferably proximate to the continuous sheet supply means while in the sheet supply position, and is swung, pivoting on the pivot shaft, away from the continuous sheet supply means to attain the separation position, thereby separating the automatic sheet supply mechanism and the continuous sheet supply means.

The automatic sheet supply mechanism preferably includes a hopper means for containing a number of cut sheets in a stack having a thickness corresponding to the number of cut sheets, the stack including a top sheet adjusted to a position by the hopper according to the thickness of the stack; and separation means with an external frame detachably supporting the hopper means, the external frame being engaged with the pivot shaft for supporting the automatic sheet supply mechanism thereon, the separation means being in opposition contact with top sheet while the top sheet is at the position, the separation means being for separating the top sheet from the stack.

The printer preferably further comprises a drive source provided to the printer body for generating motive power to drive the separation means and the continuous sheet supply means; and a motive power transmission mechanism for transmitting motive power generated at the drive source selectively to one of the separation means and the continuous sheet supply means.

The printer preferably further comprises roller means provided between the printing section and the automatic sheet supply mechanism for transporting cut sheet paper from the guide means to the printing section.

The motive power transmission mechanism preferably selectively transits power to the roller means.

The automatic sheet supply mechanism preferably further comprises a guide means for guiding manually supplied cut sheet paper to the roller means.

At least one section of the guide means is preferably provided to the hopper and capable of switching between a closed mode, for enclosing the stack of paper in the hopper, and an open mode, for allowing resupply of cut sheet paper to the hopper, supply of cut sheet paper to the automatic sheet supply mechanism being possible when the one section is in the closed mode and the open mode.

The printer preferably further comprises a first surface formed in the printer housing, the first surface adjacent to the automatic sheet supply mechanism while the automatic sheet supply mechanism is in the separation position; and a second surface formed in the printer housing substantially in alignment with the continuous sheet supply means, the first surface and the second surface defining a space adjacent to the printing section, the space broadening at increasing distance from the printing section, the pivot shaft supporting the automatic sheet supply mechanism in the space.

In the printer according to the present invention, thus constructed, when changing the continuous sheet relative to the continuous sheet feed means, the automatic sheet supply mechanism is pivoted about the pivot shaft from the cut sheet supply position to the separation position at which the automatic sheet feeding mechanism is fixed by the fixing means. Therefore, the automatic sheet supply mechanism is sufficiently distant from the continuous sheet feeding means, so that a space is easily provided for replacing the continuous sheet.

BRIEF DESCRIPTION OF THE DRAWINGS

The above and other objects, features and advantages of the invention will become more apparent from reading the following description of the preferred embodiment taken in connection with the accompanying drawings in which:

FIG. 7 (B) is an explanatory diagram showing relative positions of the motive power transmission mechanism shown in FIG. 7 (A) while cut sheet paper is being supplied from the automatic sheet supply mechanism;

FIG. 7 (C) is an explanatory diagram showing relative positions of the motive power transmission mechanism shown in FIG. 7 (A) while cut sheet paper is being supplied from the automatic sheet supply mechanism.

DETAILED DESCRIPTION OF THE PREFERRED EMBODIMENTS

Figure 1:
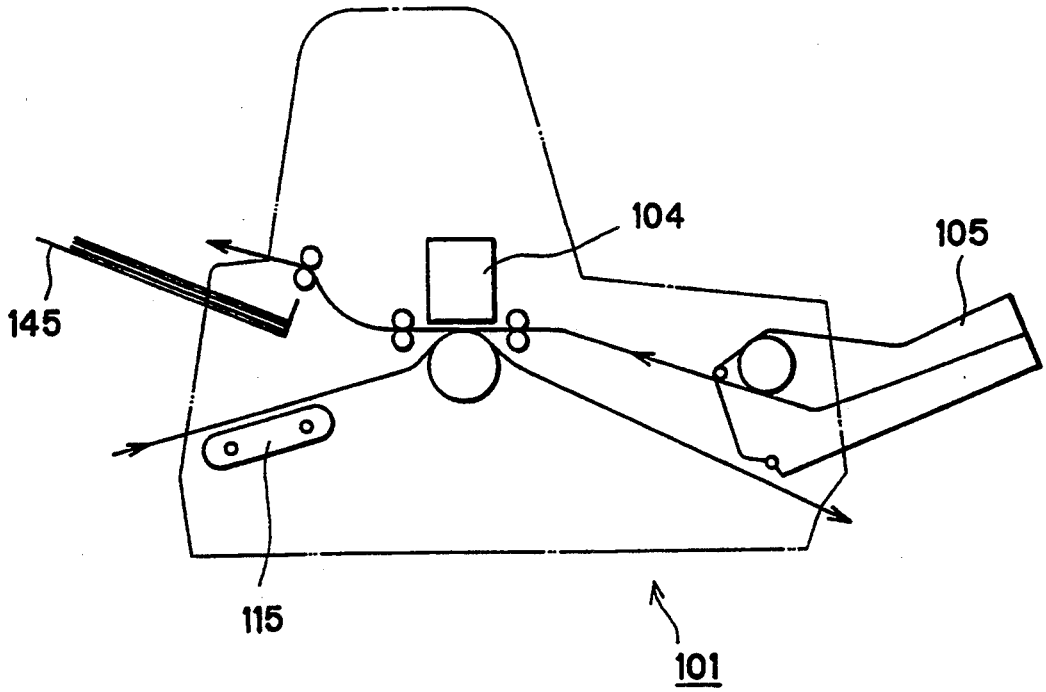
FIG. 1 PRIOR ART
FIG. 1 is a cross-sectional diagram schematically showing a conventional printer.

A printer according to a preferred embodiment of the present invention will be described while referring to the accompanying drawings wherein-like parts and components are designated by the same reference numerals.

Figure 3:
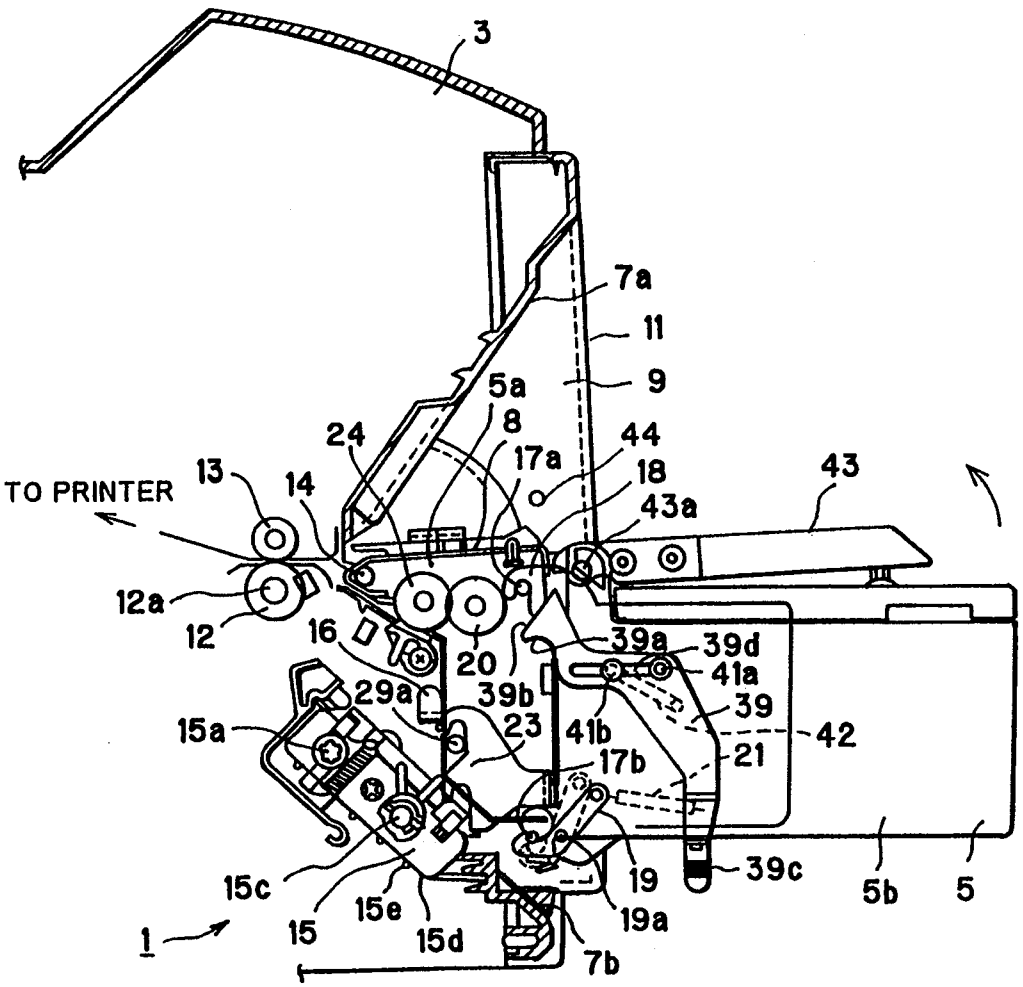
FIG. 3 is a cross-sectional diagram showing essential elements of a preferred embodiment of the present invention.

First, an explanation of the main structure of the printer 1 will be provided. FIG. 3 is an explanatory diagram showing essential elements of the present embodiment. As shown in FIG. 3, the printer according to the present embodiment comprises a printer body 3 and an automatic sheet supply mechanism 5. To facilitate explanation, the right side of FIG. 3 will be considered the front of the printer and the left side will be considered the rear.

Figure 4:
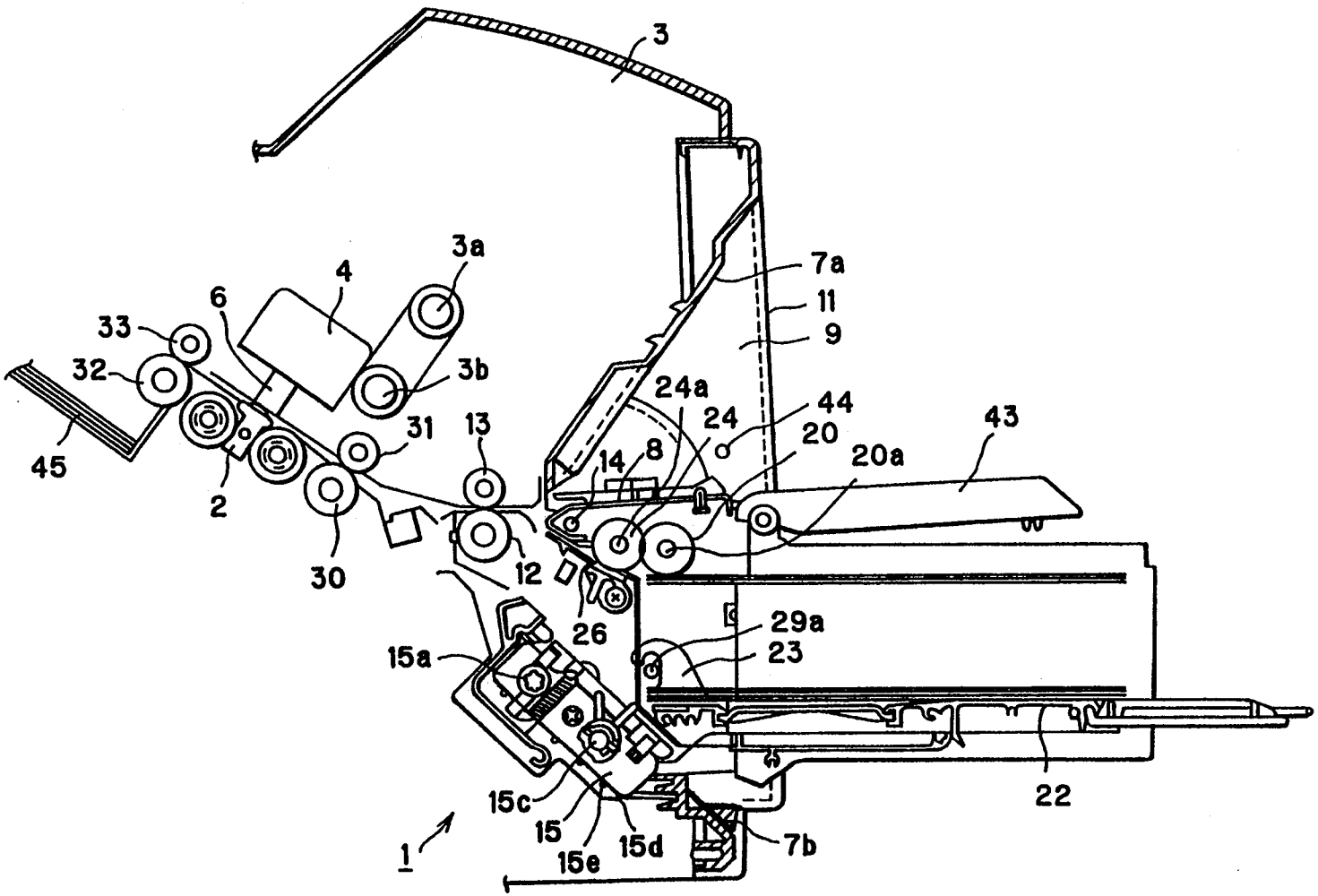
FIG. 4 is cross-sectional diagram showing essential elements of a printing section of the printer shown in FIG. 3.

A printing section including a platen 2, a printhead 4, and the like is disposed within the printer body 3 as shown in FIG. 4. A slanting upper wall **7*a* and a slanting lower wall 7*b* of in the printer body 3 define a space 9. The space 9 is generally triangular when viewed from the angle shown in FIG. 3 with apex of the triangular shape facing the printing section and base facing frontwards. An opening 11 defined by the base of the triangular shaped space 9 connects the space 9 with the external area in front of the printer. A pivot shaft 14 is horizontally disposed across this space 9 from the left to the right side of the frame of the printer body 3. Further, two fixing shafts 44 (only one is shown in FIG. 3) are horizontally disposed to the sides of the frame, one to the left side and one to the right side, so as to protrude into this space 9. Fixing shafts 44 are engagable with fixing hooks 39*a* of fixing levers 39 (to be described later). The fixing shafts 44 and the fixing levers 39** form a fixing means.

The tractor 15, which acts as a continuous sheet supply means, is supported in alignment with the slanting lower wall **7*b* by a drive shaft 15*a* and a guide shaft 15*c*. An endless belt 15*d* with engagement protuberances 15*e* at its edges extends around this tractor 15. Holes formed along the edges of the continuous sheet engage with the engagement protuberances 15*e* provided to the belt 15*d*. Rotation of this belt 15*d*** draws continuous sheet thus engaged into the printer and supplies it to the printer section.

The automatic sheet supply mechanism 5 is constructed from an integrally connected first housing **5*a* and second housing 5*b*. The pivot shaft 14 provided to the printer body 3 pivotingly supports the automatic sheet supply mechanism 5 at the first housing 5*a* side. The automatic sheet supply mechanism covers the tractor 15 when the printer is in a cut sheet supply position shown in FIG. 3** for supplying single cut sheet paper to the printing section.

The first housing **5*a* including a pick-up roller 20 and a separating roller 24, which act as a separation means, is housed within the printer body 3 (within the space 9). That is, the front side of the first housing 5*a* is closer to the printing section than the front surface of the printer body 3. At the upper surface of the first housing 5*a* is formed a table 8 for manual feed of single cut sheets of paper. The rear surface of the first housing 5*a* abuts a stopper 16 provided to the printer body 3 which prevents the automatic sheet supply mechanism 5 from pivoting further leftward and out of the cut sheet supply position. Upper and lower horizontal lateral shafts 17***a* and 17*b* for supporting the second housing 5*b* are provided at upper and lower positions respectively at the front end of the first housing 5*a*.

As shown in FIG. 4, the second housing 5*b* includes a hopper 22 for holding single cut sheet paper in a stack. As shown in FIG. 3, the second housing 5*b* also includes an engagement portion 19 and a hook portion 18. The engagement portion 19 is pivotingly disposed to the lower portion at the rear side of the second housing 5*b* via a shaft 19*a* and is continuously urged to pivot clockwise by a spring 21. The hook portion 18 is provided to the upper portion at the rear side of the second housing 5*b*. The engagement portion 19 and the hook portion 18 detachably connect the second housing 5*b* at the two horizontal lateral shafts 17*a* and 17*b* of the first housing 5*a*. That is, to connect the second housing 5*b* to the first housing 5*a*, the hook portion 18 is first engaged with the horizontal lateral shaft 17*a* while the lower rear portion of the second housing 5*b* is slightly separated from the lower front portion of the first housing 5*a*. The second housing 5*b* is then pivoted slightly clockwise on the horizontal lateral shaft 17*a* so that the engagement portion 19 engages with the horizontal lateral shaft 17*b* via the urging force of the spring 21.

A lid 43 is disposed to the upper portion of the second housing 5*b* by a hinge 43*a* so as to be capable of being opened and closed. The upper surface of this lid 43 and the table 8 provided to the first housing 5*a* are substantially coplaner so as to form a guide means. This lid 43 is opened to refill the hopper 22 with single cut sheet paper. Automatic supply of cut sheet paper is possible whether the lid 43 is opened or closed.

Figure 5:
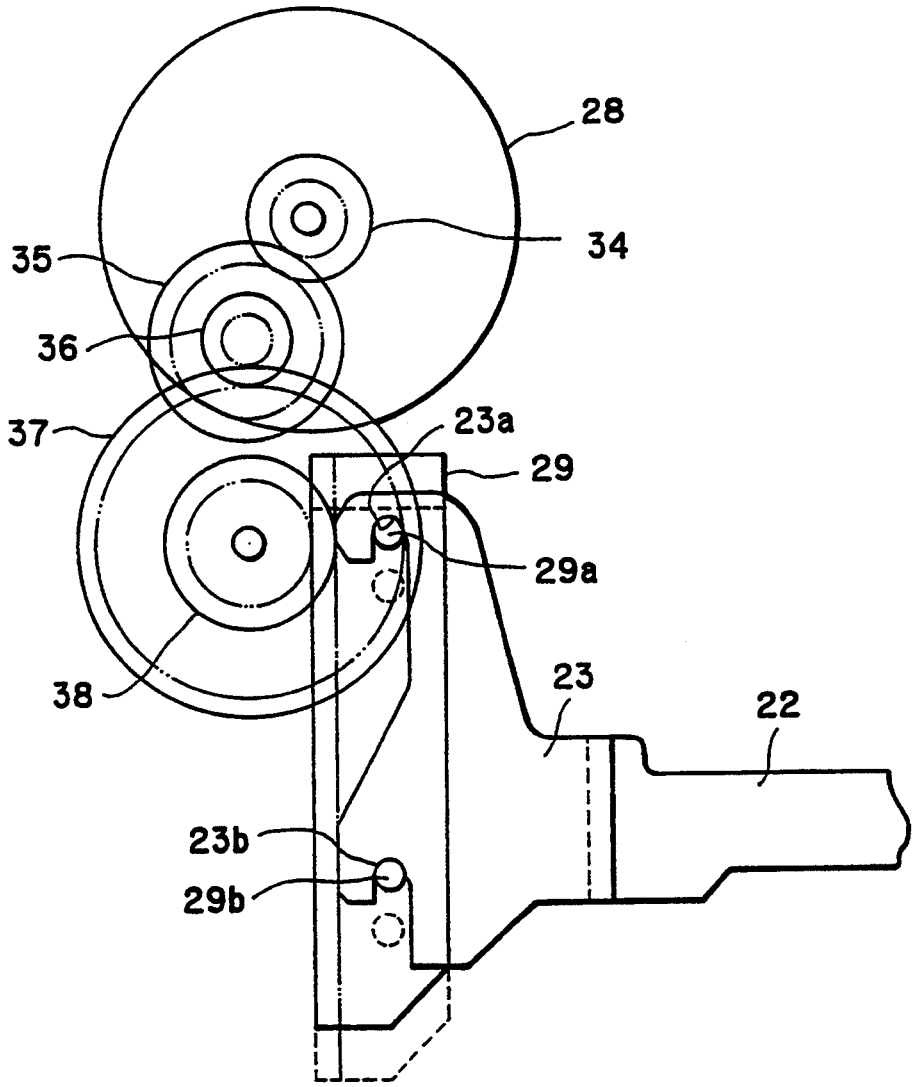
FIG. 5 is a schematic diagram showing essential elements of a hopper raising assembly of the printer shown in FIG. 3.

As shown in FIG. 3 and 4, the hopper 22 provided to the second housing 5*b* is connected to two hopper hooks 23 (only one of which is shown in the drawings) positioned at the rear of the first housing 5*a* side. As shown in FIG. 5, hopper raising assemblies provided at both the left and the right sides of the printer body 3 each include one hopper hook 23, a hopper motor 28, first through fifth gears 34 to 38, and a rack gear 29. In one hopper raising assembly, the hopper hook 23 has an upper engagement recess portion 23*a* and a lower engagement recess portion 23*b*. The rack gear 29 is a linear gear with upper support shaft 29*a* and lower support shaft 29*b* disposed at positions so as to engage with the engagement recess portions 23*a* and 23*b* of the hopper hook 23. The gears are disposed so that rotation of the rotation shaft in the hopper motor 28 is conveyed to the fifth gear 38 (pinion) via the first gear 34, the second gear 35, the third gear 36, and the fourth gear 37 in the order listed. The rack gear 29 converts the rotational movement of the fifth gear 38 into linear movement by engaging with the teeth of the fifth gear 38. Because the upper support shaft 29*a* and lower support shaft 29*b* engage with the engagement recess portions 23*a* and 23*b* of the hopper hook 23, the hopper 22 moves upward and downward with upward and downward movements of the rack gear 29. However, when the rack gear 29 is at the lowest point (indicated by a dash line in FIG. 6), both support shafts 29*a* and 29*b* of the rack gear 29 are retracted to a lower position where they no longer engage the engagement recess portions 23*a* and 23*b* of the hopper hook 23. In this condition the second housing 5*b* including the hopper 22 can be disconnected from the first housing 5*a* when the engagement portion 19 is disengaged from the engagement shaft 17*b*. The hopper motor 28 is controlled by a microcomputer (to be described later) so that the pick-up roller 20 abuts the top single cut sheet of the single cut sheets stacked in the hopper 22.

As mentioned above, the automatic sheet supply mechanism also includes fixing levers 39 provided at both sides of the second housing 5*b*. The following explanation is in regards to the fixing lever 39 shown in FIG. 3. However, it should be noted that an identical fixing lever 39 and relevant components are provided to the opposite side of the second housing 5*b*. The fixing lever 39 includes a grip 39*c* at its lower end and an incline surface 39*b*, which acts as a cam, and a fixing hook 39*a* at its upper end. A slide channel 39*d* formed in the fixing lever 39 slidably engages the fixing lever 39 to protuberances 41*a* and 41*b* provided linearly in the frontward and rearward direction on the side of the second housing 5*b*. The fixing levers 39 provided on both sides of the second housing are slidably movable parallel with each other in the forward and rearward directions. A spring 42 fixed at one end to the tip of the rearward protuberance 41*b* and at the other end to the fixing lever 39 continuously urges the fixing lever 39 rearward.

Next, an explanation will be provided for the transport pathway of paper to the printer 1. FIG. 4 is an explanatory diagram showing the transport pathway of the paper (both single cut sheet and continuous sheet) for the printer 1 as viewed from the left hand side of the printer 1.

Guide shafts 3*a* and 3*b* are fixed to the printer body 3. A carriage (not shown) with a printhead 4 is returnably movable leftward and rightward by a drive motor and a timing belt (not shown) following the guides shafts 3*a* and 3*b*. The printhead 4 include nozzles 6 for printing characters on a print paper positioned on the platen 2.

A feed roller 12 and a pinch roller 13 are provided as a roller means to the printer body 3 between the printing section and the first housing 5*a* of the automatic sheet supply mechanism. The feed roller 12 and the pinch roller 13 supply to the printer section either single cut sheet paper inserted manually via the table 8 provided to the first housing 5*a* or single cut sheet paper drawn in by the automatic sheet supply mechanism 5.

The automatic sheet supply mechanism 5 supplies single cut sheet paper to the printing section one sheet at a time using well-known technology. That is, rotation of the pick-up roller 20 feeds single cut sheet paper stacked in the hopper 22 to the separation roller 24. Rotation of the separation roller 24 separates single cut sheet paper between the separation roller 24 and .the separation pad 26 and transports the separated cut sheet paper toward the printing section.

Single cut sheet paper drawn in by the feed roller 12 10 and the pinch roller 13, and also continuous sheet drawn in by the tractor 15, is sandwiched between the feed roller 30 and the pinch roller 31. Rotation of the feed roller 30 feeds the paper through the printing section formed by the platen 2 and the nozzle body 6 of the printhead 4. Continuous sheet and single cut sheet paper that passes through the printing section in this way is sandwiched between the feed roller 32 and the pinch roller 33 and discharged to the top of the paper accumulation stacker 45 provided at the rear portion of the printer body 3.

Figure 6:
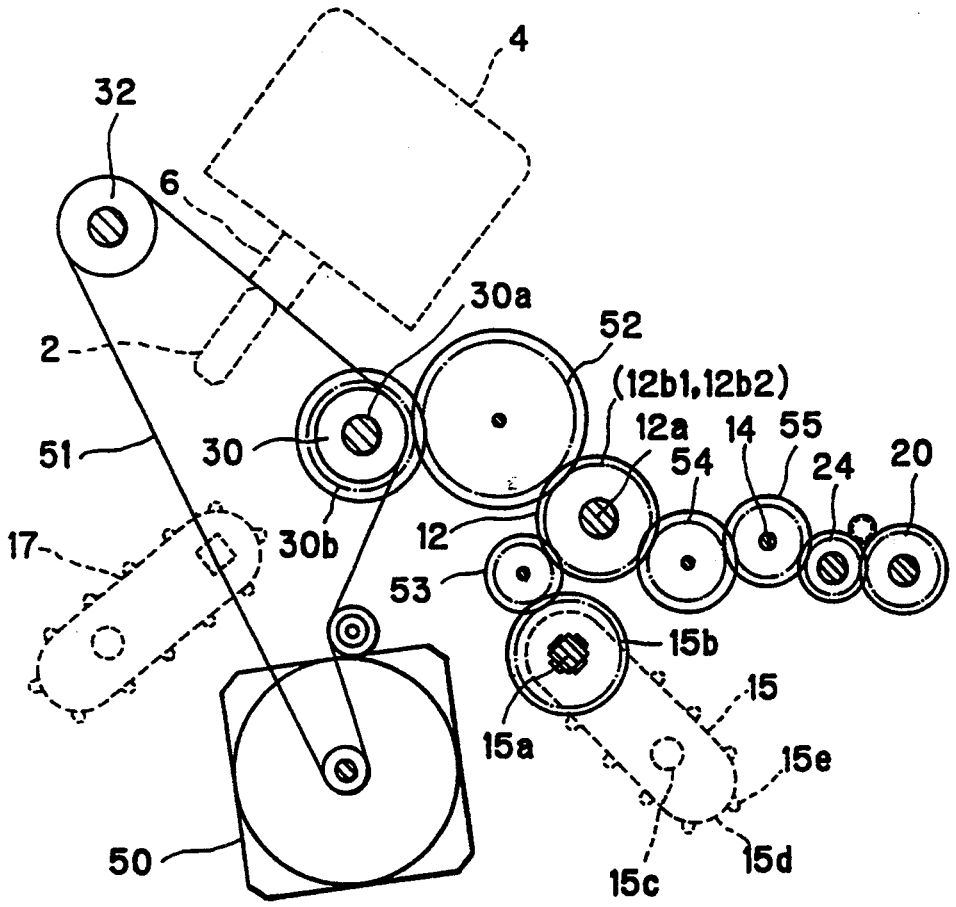
FIG. 6 is a cross-sectional diagram showing essential elements of a transport pathway of sheet paper to the printer shown in FIG. 3.

Next, an explanation will be provided for the motive power transmission mechanism of the preferred embodiment while referring to FIG. 6.

The drive system forming the transport pathway followed by continuous sheet and single cut sheet paper drawn in through the front of the printer 1 includes the feed roller 12, the tractor 15, the feed roller 30, and the feed roller 32.

First, transmission of motive power from the drive motor 50, which acts as a drive source, to the feed roller 12 will be explained. Motive power in the form of rotational motion generated at the drive motor 50 is transmitted to the feed rollers 30 and 32 via the timing belt 51. The feed roller 30 transmits the motive power to its rotation shaft 30*a*, which in turn transmits the motive power to the drive gear 30*b* provided thereto. The drive gear 30*b* transfers the motive power to an idle gear 52 in engagement therewith. The idle gear 52 in turn transmits the motive power to a drive gear 12*b*1 fixedly disposed to the rotational axis 12*a* of the feed roller 12, thereby rotating the feed roller 12.

Next, transmission of motive power to the tractor 15 will be described. The drive gear 12*b*1 is selectively engagable with an idle gear 53 as will be described later. Motive power transmitted to the drive gear 12*b*1 as described above is therefore transmitted to the idle gear 53 when these two gears are engaged. Motive power is transmitted from the idle gear 53 to a drive gear 15*b* engaged therewith. The drive gear 15*b* is provided to the drive shaft 15*a* of the tractor 15 so that motive power transmitted to the drive gear 15*b* is transmitted to the tractor 15.

Next, transmission of motive power to the pick-up roller 20 and the separation roller 24 of the automatic sheet supply mechanism 5 will be described. An idle gear 12*b*2 is disposed to the rotation shaft 12*a* of the feed roller 12 adjacent to the drive gear 12*b*1 so as to be freely movable in the rotation direction, but not the axial direction, of the rotational shaft 12*a*, The idle gear 53 is also selectively engagable with the idle gear 12*b*2 in a manner to be described later. As will also be described in more detail later, when both the idle gear 12*b*2 and the drive gear 12*b*1 are engaged with the idle gear 53, motive power from drive gear 12*b*1 is transmitted to the idle gear 12*b*2. Motive power transmitted to the idle gear 12*b*2 is transmitted to the idle gear 54 engaged therewith. Motive power from the idle gear 54 is transmitted to the idle gear 55 engaged therewith and then to the separation roller 24. Because the idle gear 54 is supported by the pivot shaft 14 so as to be rotatable about its own axis, the idle gears 54 and 55, and the separation roller 24, remain engaged even when the automatic sheet supply mechanism 5 is pivoted on the pivot shaft 14.

A conventional conversion mechanism, using, for example, an electromagnetic clutch, is provided in the rotation shafts 20*a* and 24*a* of the pick-up roller 20 and the separation roller 24 respectively for converting between a mode for separating and supplying one sheet of the cut sheet paper at a time, wherein only the separation roller 24 drives in the paper supply direction of the cut sheet paper, and a mode wherein both the separation roller 24 and the pick-up roller 20 drive in the supply direction of the cut sheet.

The motive power transmission mechanism will be explained in more detail below while referring to FIGS. 7(A)–(C). By this motive power transmission mechanism, manually fed cut sheet paper, cut sheet paper supplied by the automatic sheet feed mechanism 5, or continuous sheet by the tractor can be selectively supplied to the printing section.

Figure 7A:
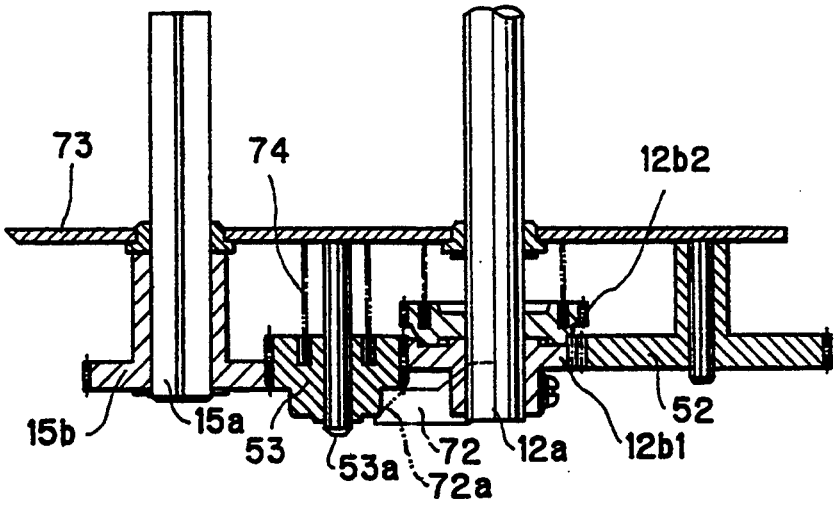
FIG. 7 (A) is an explanatory diagram showing relative positions of essential elements in a motive power transmission mechanism of the printer shown in FIG. 3 while continuous sheet is being supplied.
Figure 7B:
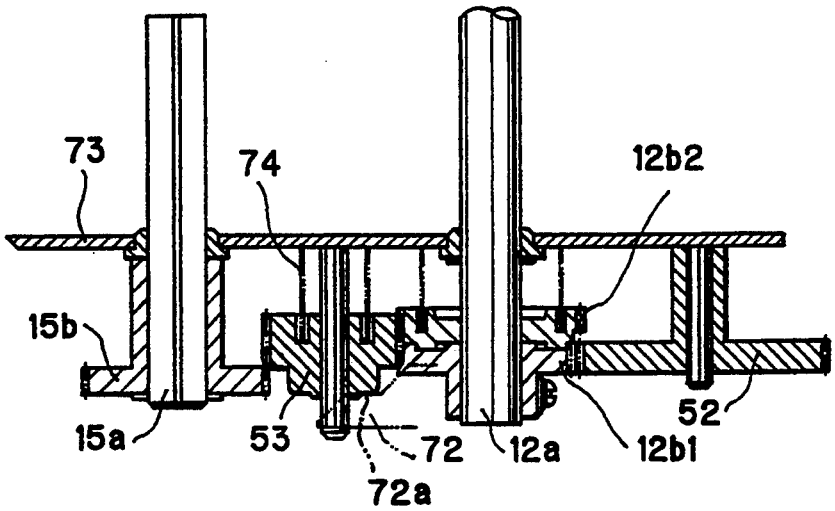
Figure 7C:
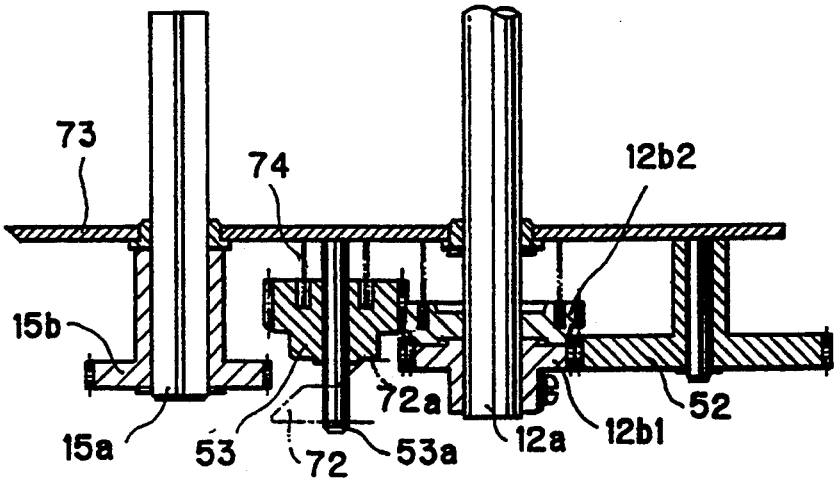

As shown in FIG. 7(A)–7(C), the idle gear 53 is rotatably engagedly supported by a shaft 53*a* disposed to the frame 73 of the printing mechanism body 2. A compression spring 74 disposed between the idle gear 53 and the frame 73 of the printing mechanism body 3 urges the idle gear 53 away from the frame 73. A supplementary cam 72 with a three-step cam portion 72*a* is rotatably disposed near the idle gear 53. Rotation of the supplementary cam 72 is controlled by commands from the control panel (to be described later) to selectively bring the steps of the three-step cam portion 72*a* into abutment with the idle gear 53. The idle gear 53 moves in the axial direction of the shaft 53*a* by rotation of the supplementary cam 72. Changes in the position of the idle gear 53 by the rotation of the supplementary cam 72 can individually isolate transmission of motion to the tractor 15 and to the automatic sheet supply mechanism 5.

Axial movement of the idle gear 53 switches the motive power transmission mechanism between a continuous sheet supply mode shown in FIG. 7 (A), an automatic cut sheet supply mode shown in FIG. 7 (B), and a manual cut sheet supply mode shown in FIG. 7 (C). In the continuous sheet supply mode motive power is transmitted from the drive gear 12*b*1 fixed to the rotation shaft 12*a* of the feed roller 12 to the drive gear 15*b* fixed to the drive shaft 15*a* of the tractor 15. In the automatic cut sheet supply mode, the idle gear 53 engages with both the drive gear 12*b*1 and the idle gear 12*b*2 so that motive power is transmitted from the drive gear 12*b*1 to the idle gear 12*b*2, and therefore to the idle gear 54 (not shown) engaged thereto, for driving the automatic sheet supply mechanism 5. In the manual cut sheet supply mode, both the idle gear 12*b*2 and the drive gear 15 are isolated from the motive power of the drive gear 12*b*1 so that only the feed roller 12 rotates.

In a printer 1 according to the present embodiment constructed in this way, the drive of the drive motor 50, the hopper motor 28, and the like, are controlled by a microcomputer including a CPU, a ROM, and a RAM (not shown).

Next, supply of continuous sheet and cut sheet paper in the printer 1 will be explained below based on FIGS. 4, 6 and 7(A)–7(C).

To supply continuous sheet, a continuous sheet supply switch provided to a control panel (not shown) is manipulated to instruct the microcomputer to this effect. The microcomputer then causes the supplementary cam 72 to rotate so as to move the idle gear 53 to the position shown in FIG. 7 (A). In this mode, the motive power in the form of rotation movement from the drive motor 50 is transmitted to the tractor 15, which draws in continuous sheet and passes it to the feed roller 30 and the pinch roller 31. The feed roller 30 and the pinch roller 31 then supplies the continuous sheet to the printing section.

To automatically supply cut sheet paper by the automatic sheet supply mechanism 5, a cut sheet paper automatic supply switch provided to the control panel (not shown) is manipulated to instruct the microcomputer to this effect. The microcomputer causes the supplementary cam 72 to rotate so as to move the idle gear 53 to the position indicated in FIG. 7 (B). In this mode, the motive power from the drive motor 50 is transmitted to the rotation shaft 12*a* of the feed roller 12, then to the drive gear 12b1, to the idle gear 53, to the idle gear 12b2, and to the idle gear 54 in the order listed. In this way, the automatic sheet supply mechanism 5 is driven by the rotation of the drive motor 50 so that only one sheet of cut sheet paper stacked in the hopper 22 is separated, drawn in by the feed roller 12 and the pinch roller 13, and supplied to the printing section by the feed roller 30 and the pinch roller 31. Because the idle gear 53 is not engaged with the drive gear 15b, the tractor 15 does not rotate.

To manually feed cut sheet paper to the printer, a manual feed switch provided to the control panel (not shown) is manipulated to instruct the microcomputer to this effect. The microcomputer then causes the supplementary cam 72 to rotate so as to move the idle gear 53 to the position shown in FIG. 7 (C). In this mode, motive power from the drive motor 50 is transmitted to the drive gear 12b1 of the feed roller 12, but isolated from the drive gear 15b and the idle gear 12b2. Thus, manually fed cut sheet paper is drawn in by the feed roller 12 and the pinch roller 13, and is supplied to the printing section by the feed roller 30 and the pinch roller 31, but the tractor 15 and the automatic sheet supply mechanism do not operate by the rotation of the drive motor 50.

Figure 8:
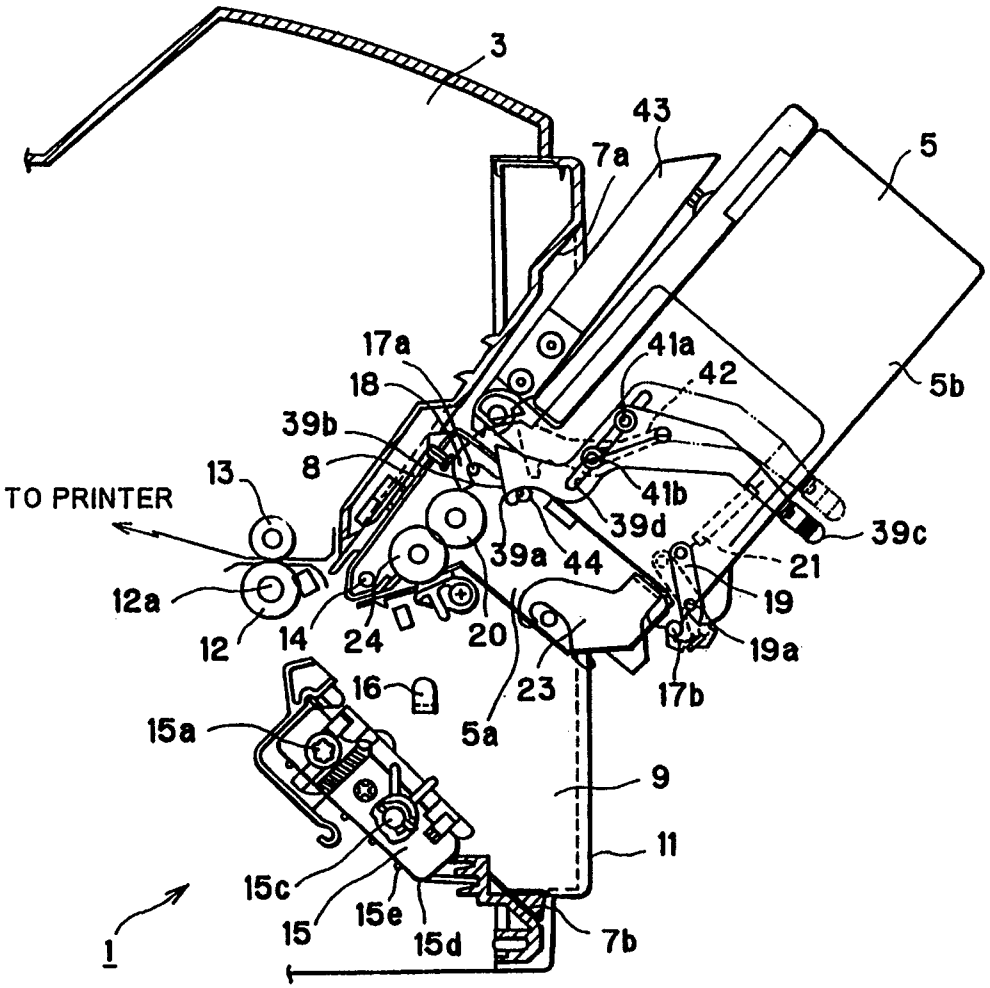
FIG. 8 is a cross-sectional diagram showing a continuous sheet replacement mode of the printer shown in FIG. 3 wherein an automatic sheet supply mechanism is fixed in a separation position.

Next, operations for replacing the continuous sheet will be explained in further detail based on FIGS. 3 and 8. FIG. 8 is an explanatory diagram showing a continuous sheet replacement mode wherein the automatic sheet supply mechanism is fixed in a separation position.

To replace the continuous sheet, the automatic sheet supply mechanism 5 is pivoted in the counterclockwise direction on the pivot shaft 14. Before the upper surface of the automatic sheet supply mechanism 5, that is, the table 8 and the upper surface of the lid 43, reaches the slanted upper surface 7a of the printer body 3, the pressure cam surface 39b of the fixing lever 39 supported at the outer surface of the automatic sheet supply mechanism 5 abuts the fixing shaft 44 horizontally disposed to the sides of the frame to protrude into the space 9. The motive power produced by pivoting the automatic sheet supply mechanism 5 is transmitted to the fixing lever 39 by the pressure cam surface 39b sliding along the fixing shaft 44. The fixing lever 39 moves forward against the urging force of the spring 42 to attain a non-engagement position (indicated by the double-dash chain line in FIG. 8). Just before the upper surface of the automatic sheet supply mechanism 5 reaches the slanted upper surface 7a , the pressure cam surface 39b is brought out of contact with the fixing shaft 44. The urging of the spring 42 then is allowed to force the fixing lever 39 rearward so that the fixing hook 39a engages with the fixing shaft 44 and the fixing lever 39 is fixed in an engagement position (indicated in FIG. 8 by the solid line). The automatic sheet supply mechanism 5 becomes fixed in the separation position shown in FIG. 8. The tractor 15 is sufficiently revealed to allow an operator to easily and correctly engage the holes provided at both sides of the replacement continuous sheet with the engagement protrusions on the tractor 15.

To return the automatic sheet supply mechanism 5 to the sheet supply position indicated in FIG. 3 after the, continuous sheet is replaced, an operator slightly raises the automatic sheet supply mechanism 5 and disengages the fixing hook 39a from the fixing shaft 44 by pulling the grip portion 39c of the fixing lever 39 forward, thereby returning the fixing lever 39 to the non-engagement position. The automatic sheet supply mechanism 5 then pivoted in the clockwise direction on the pivot shaft 14 until the rear surface of the first housing 5a of the automatic sheet supply mechanism 5 abuts the stopper 16 provided to the printer body 3.

The effects of the printer according the above-described embodiment will be described below.

Because the automatic sheet supply mechanism 5 can be pivoted on the pivot shaft 14 from the sheet supply position to the separation position and can be fixed in the separation position by the fixing lever 39 and the fixing shaft 44, space necessary for replacement of the continuous sheet is easily secured and continuous sheet can be easily replaced.

Figure 2:
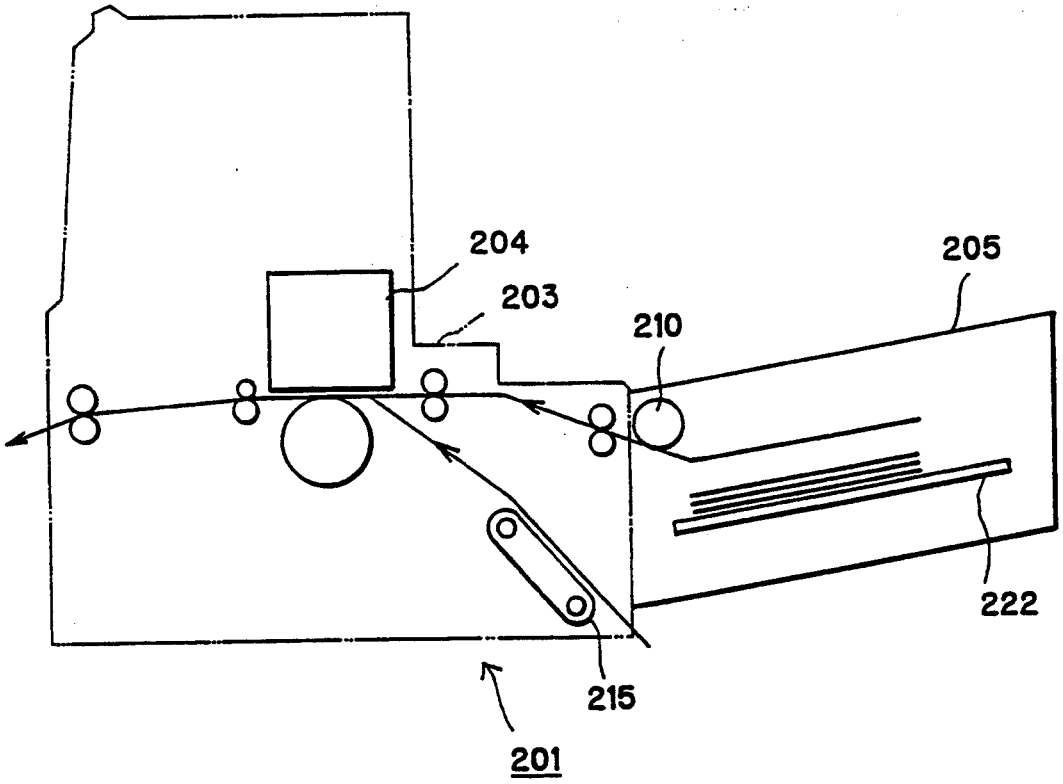
FIG. 2 PRIOR ART
FIG. 2 is a cross-sectional diagram schematically showing another conventional printer.

Because the first housing 5a (separation means) and the second housing 5b (hopper means) of the automatic sheet supply mechanism 5 are detachable and because the first housing is contained within the printer body 3, the entire printer 1 can be shortened in the front and rear direction in comparison to the conventional printer 201 shown in FIG. 2 and installation area can be reduced. Further, because the printer 1 is shortened, the control panel is easier to operate than the printer 201 in FIG. 2.

The printer is very adaptable because types of cut sheet paper other than the type held in the automatic sheet supply mechanism 5 can be manually inserted by the table 8 and the upper surface of the lid 43 (guide means).

Manually inserted cut sheet paper, cut sheet paper supplied by the automatic sheet supply mechanism 5, or continuous sheet supplied by the tractor 15 can be selectively supplied to the printing section by entering an instruction at the control panel to cause the motive power transmission mechanism to transmit motive power from the drive motor 50 to the feed roller 12, the pick-up roller 20, or the tractor 15 respectively.

Because the pinch roller 13 and the feed roller 12 are provided in the printer body 3 as a roller means, cut sheet paper can be accurately supplied to the printing section.

Because the lid 43 provided to the automatic sheet supply mechanism 5 can open and close, resupply of cut sheet paper can be easily executed.

Because a space 9 is opened in the front of the printer body 3 facing away from the printer portion and because the automatic sheet supply mechanism 5 pivots in the space 9, the entire printer 1 can be shortened in the front-rear direction and sufficient space for replacing continuous sheet can be secured. Further, because the pivoting angle of the automatic sheet supply mechanism 5 does not exceed 90 degrees, the cut sheet paper stacked in the hopper 22 does not slide out of place and remains neatly stacked even when the automatic sheet supply mechanism 5 is in the separation position.

As described in detail above, both cut sheet paper and continuous sheet can be supplied and continuous sheet can be simply replaced in a printer according to the present invention.

If the separation means and the hopper means which comprise the automatic sheet supply mechanism are detachable, and moreover, if a structure is applied where the separation means is contained within the printer body, the length of the printer in the front and rear directions can be shortened, and installation area can be reduced.

If a guide means is added to the automatic sheet supply mechanism for manually supplying cut sheet paper, general-purposeness of the device can be increased.

If one drive source for generating a drive motive power is provided to the printer body, and if a structure is provided to selectively transmit the drive motive power to either the continuous sheet means or the cut sheet means by a command from an external portion, printing can be optionally, selectively performed on either the cut sheet paper or the continuous sheet.

By providing a roller means to the printer body, cut sheet paper can be accurately supplied to the printing section.

By providing a lid that can be opened and closed to the automatic sheet supply mechanism, resupply operation of the cut sheet paper can be easily executed.

Further, by the printer body having a space opening in the forward outward direction from the printer portion side and by the automatic sheet supply mechanism pivoting within the space, the length of the entire printer can be shortened in the front-rear direction and even if the automatic sheet supply mechanism reaches the separation position, because the pivoting angle of the automatic sheet supply mechanism does not exceed 90 degrees, the cut sheet paper stacked in the hopper does not slide out of position.

While the invention has been described in detail with reference to specific embodiments thereof, it would be apparent to those skilled in the art that various changes and modifications may be made therein without departing from the spirit of the invention.

What is claimed is:

1. A printer including a printing section capable of printing on both continuous sheet and cut sheet paper, comprising:

a printer housing containing the printing section, a pivot shaft being provided to tile printer housing;

continuous sheet supply means for supplying continuous sheet to the printing section;

an automatic sheet supply mechanism supported by the pivot shaft and pivotable between a cut-sheet supply position, for supplying one cut sheet at a time to the printing section, and a separation position, for separating the automatic sheet supply mechanism from the continuous sheet supply means and for providing an open space therebetween; and a fixing means for fixing the automatic sheet supply mechanism in the separation position.

2. A printer as claimed in claim 1 wherein the fixing means comprises:

a fixing shaft provided at a predetermined position on the printer housing; and a fixing lever movably supported to the automatic sheet supply mechanism between an engagement position, for engaging the fixing lever with the fixing shaft thereby fixing the automatic sheet supply mechanism in the separation position, and a non-engagement position, for releasing engagement between the fixing lever and the fixing shaft.

3. A printer as claimed in claim 2 wherein the automatic sheet supply mechanism is proximate to the continuous sheet supply means while in the paper supply position, and is swung, pivoting on the pivot shaft, away from the continuous sheet supply means to attain the separation position, thereby separating the automatic sheet supply mechanism and the continuous sheet supply means.

4. A printer as claimed in claim 3, wherein the automatic sheet supply mechanism comprises:

hopper means for containing a number of cut sheets in a stack having a thickness corresponding to the number of cut sheets, the stack including a top sheet adjusted to a position by the hopper according to the thickness of the stack; and separation means with an external frame detachably supporting the hopper means, the external frame being engaged with the pivot shaft for supporting the automatic sheet supply mechanism thereon, the separation means being in opposition contact with top sheet while the top sheet is at the position, the separation means being for separating the top sheet from the stack.

5. A printer as claimed in claim 4, further comprising:

a drive source provided to the printer housing for generating motive power to drive the separation means and the continuous sheet supply means; and a motive power transmission mechanism for transmitting motive power generated at the drive source selectively to one of the separation means and the continuous sheet supply means.

6. A printer as claimed in claim 5, further comprising:

roller means provided between the printing section and the automatic sheet supply mechanism for transporting cut sheet paper from the automatic sheet supply mechanism to the printing section.

7. A printer as claimed in claim 6 wherein the motive power transmission mechanism selectively transits power to the roller means.

8. A printer as claimed in claim 7, wherein the automatic sheet supply mechanism further comprises:

guide means for guiding manually supplied cut sheet paper to the roller means.

9. A printer as claimed in claim 8, wherein at least one section of the guide means is provided to the hopper and capable of switching between a closed mode, for enclosing the stack of paper in the hopper, and an open mode, for allowing resupply of cut sheet paper to the hopper, supply of cut sheet paper to the automatic sheet supply mechanism being possible when the one section is in the closed mode and the open mode.

10. A printer as claimed in claim 9, wherein the printer housing includes:

a first surface formed in the printer housing, the first surface adjacent to the automatic sheet supply mechanism while the automatic sheet supply mechanism is in the separation position; and a second surface formed in the printer housing substantially in alignment with the continuous sheet supply means, the first surface and the second surface defining a space adjacent to the printing section, the space broadening at increasing distance from the printing section, the pivot shaft supporting the automatic sheet supply mechanism in the space.

11. A printer as claimed in claim 2, wherein the automatic sheet supply mechanism comprises:

hopper means for containing a number of cut sheets in a stack having a thickness corresponding to the number of cut sheets, the stack including a top sheet adjusted to a position by the hopper according to the thickness of the stack; and separation means with an external frame detachably supporting the hopper means, the external frame being engaged with the pivot shaft for supporting the automatic sheet supply mechanism thereon, the separation means being in opposition contact with top sheet while the top sheet is at the position, the separation means being for separating the top sheet from the stack.

12. A printer as claimed in claim 11, further comprising:

a drive source provided to the printer housing for generating motive power to drive the separation means and the continuous sheet supply means; and a motive power transmission mechanism for transmitting motive power generated at the drive source selectively to one of the separation means and the continuous sheet supply means.

13. A printer as claimed in claim 12, further comprising:

roller means provided between the printing section and the automatic sheet supply mechanism for transporting cut sheet paper from the automatic sheet supply mechanism to the printing section.

14. A printer as claimed in claim 1 wherein the automatic sheet supply mechanism is proximate to the continuous sheet supply means while in the paper supply position, and is swung, pivoting on the pivot shaft, away from the continuous sheet supply means to attain the separation position, thereby separating the automatic sheet supply mechanism and the continuous sheet supply means.

15. A printer as claimed in claim 14, wherein the printer housing includes:

a first surface formed in the printer housing, the first surface adjacent to the automatic sheet supply mechanism while the automatic sheet supply mechanism is in the separation position; and a second surface formed in the printer housing substantially in alignment with the continuous sheet supply means, the first surface and the second surface defining a space adjacent to the printing section, the space broadening at increasing distance from the printing section, the pivot shaft supporting the automatic sheet supply mechanism in the space.

16. A printer as claimed in claim 1, wherein the automatic sheet supply mechanism comprises:

hopper means for containing a number of cut sheets in a stack having a thickness corresponding to the number of cut sheets, the stack including a top sheet adjusted to a position by the hopper according to the thickness of the stack; and separation means with an external frame detachably supporting the hopper means, the external frame being engaged with the pivot shaft for supporting the automatic sheet supply mechanism thereon, the separation means being in opposition contact with top sheet while the top sheet is at the position, the separation means being for separating the top sheet from the stack.

17. A printer as claimed in claim 16, further comprising:

roller means provided between the printing section and the automatic sheet supply mechanism for transporting cut sheet paper from the automatic sheet supply mechanism to the printing section.

18. A printer as claimed in claim 17, wherein the automatic sheet supply mechanism further comprises:

guide means for guiding manually supplied cut sheet paper to the roller means.

19. A printer as claimed in claim 18, wherein at least one section of the guide means is provided to the hopper and capable of switching between a closed mode, for enclosing the stack of paper in the hopper, and an open mode, for allowing resupply of cut sheet paper to the hopper, supply of cut sheet paper to the automatic sheet supply mechanism being possible when the one section is in the closed mode and the open mode.

20. A printer as claimed in claim 19, wherein the printer housing includes:

first surface adjacent to the automatic sheet supply mechanism while the automatic sheet supply mechanism is in the separation position; and a second surface formed in the printer housing substantially in alignment with the continuous sheet supply means, the first surface and the second surface defining a space adjacent to the printing section, the space broadening at increasing distance from the printing section, the pivot shaft supporting the automatic sheet supply mechanism in the space.

* * * * *